United States Patent [19]

Reginato

[11] Patent Number: 4,500,058

[45] Date of Patent: Feb. 19, 1985

[54] MODULAR CONTROL PANEL FOR MINIATURE-RAILWAY SWITCHES

[75] Inventor: Francesco Reginato, Dueville, Italy

[73] Assignee: Lima S.p.A., Vicenza, Italy

[21] Appl. No.: 379,711

[22] Filed: May 19, 1982

[30] Foreign Application Priority Data

May 25, 1981 [IT] Italy ..... 21883/81[U]

[51] Int. Cl.[3] ..... B61L 25/06; B61L 27/02

[52] U.S. Cl. ..... 246/3; 116/319; 246/122 A; 246/415 A; 446/444; 446/455

[58] Field of Search ..... 246/3, 122 R, 122 A, 246/1 C, 253, 415 A, 25, 26; 46/1 K, 216, 259; 273/86 B, 86 R; 446/444, 446, 455; 116/309, 319, 222; 238/10 F, 10 E, 10 R

[56] References Cited

U.S. PATENT DOCUMENTS

| | | | |
|---|---|---|---|
| 2,094,134 | 9/1937 | Obergfell | 246/122 A |
| 2,149,225 | 2/1939 | Merkel | 246/122 A |
| 3,290,498 | 12/1966 | Lahr | 238/10 F |
| 3,343,498 | 9/1967 | Klamp | 104/130 |

FOREIGN PATENT DOCUMENTS

| | | | |
|---|---|---|---|
| 1603303 | 7/1979 | Fed. Rep. of Germany | 246/415 A |
| 1703742 | 10/1980 | Fed. Rep. of Germany | 46/1 K |
| 871694 | 6/1961 | United Kingdom | 246/122 R |

OTHER PUBLICATIONS

*Lima Railways*, 1980–1981 *English International Edition*, Sales Catalogue, p. 36.

*Primary Examiner*—David A. Scherbel
*Assistant Examiner*—Donald T. Hajec
*Attorney, Agent, or Firm*—Oblon, Fisher, Spivak, McClelland & Maier

[57] ABSTRACT

A modular control panel for controlling the switching operations in a miniature- or model-railway-line has grooves which reproduce the railway tracks, contacts being applied to the groove bottoms in the neighborhood of railway crossings, and is improved by the provision of a rotatable direction indicator placed at every line intersection so as to mask one or the other branch of a line bifurcation with one of its halves, the other half of said indicator defining the correct direction.

9 Claims, 4 Drawing Figures

Fig.2
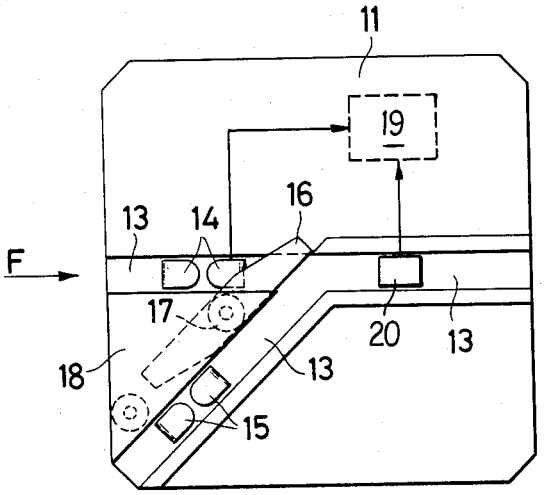
Fig.3
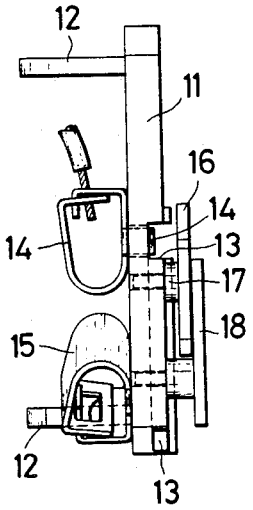
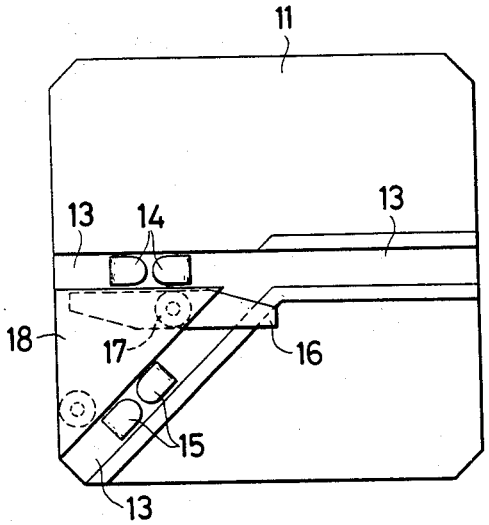
Fig.4

MODULAR CONTROL PANEL FOR MINIATURE-RAILWAY SWITCHES

In miniature railway tracks, it has already been suggested, in order to facilitate and accelerate the actuation of the switches, to provide a modular control panel composed of a number of assemblable "tiles" on which the principal parts of the railway tracks are reported.

The portion of interest of the track is reproduced by grooves in the panel and on the bottom of such grooves electric contacts are applied for actuating the several switches.

An operator closes the circuit on said paired contacts, whereafter the switching is originated by moving within the groove a stylus which is a part of the control circuitry, the stylus being run in the grooves following the route that the operator intends to select for the train. The actuation of the switch concerned takes place as the metallic stylus slides on the relevant contacts which are provided on the groove in said panel.

It is likewise known to apply in correspondence with the switches, display devices on the control panel, employing Light Emitting Diodes, or LEDs.

Such an approach, although it is functionally appreciable, has a cost which considerably influences the final cost of a panel of the kind referred to above.

An objective of the present invention is to provide a panel of the kind referred to above, which is provided with means capable of displaying the route followed by a train and which, though being as valid as the LED devices, are conversely much cheaper.

Having this objective in view, according to the invention, it has been envisaged to make an assemblable panel for controlling the switches of a miniature railway line of the kind in which said railway line is reproduced by grooves on the bottom of which there are applied contacts of an electric control circuit for the switches, said contacts being intended to be acted upon by a conductive stylus electrically connected with the control circuitry concerned, means being further provided to display the selected line trunk, characterized in that said means comprise, in correspondence with each crossing point of said grooves (switch) a rotatable direction indicator which is capable of intersecting, with either of its two portions, either groove of those which concur in the crossing point, whereas the other portion of said indicator is masked by a masking tab.

The structural and functional features of the invention and its advantages over the known art will become still clearer from the scrutiny of the exemplary description given hereafter and aided by the accompanying drawings, wherein:

FIG. 2 is a close-up plan view showing a modular element ("tile") of the panel shown in FIG. 1.

FIG. 3 is an elevational view along the direction of the arrow F of FIG. 2, and FIG. 4 is a view akin to that of FIG. 2, but showing the direction indicator placed in the opposite position.

Figure 1:
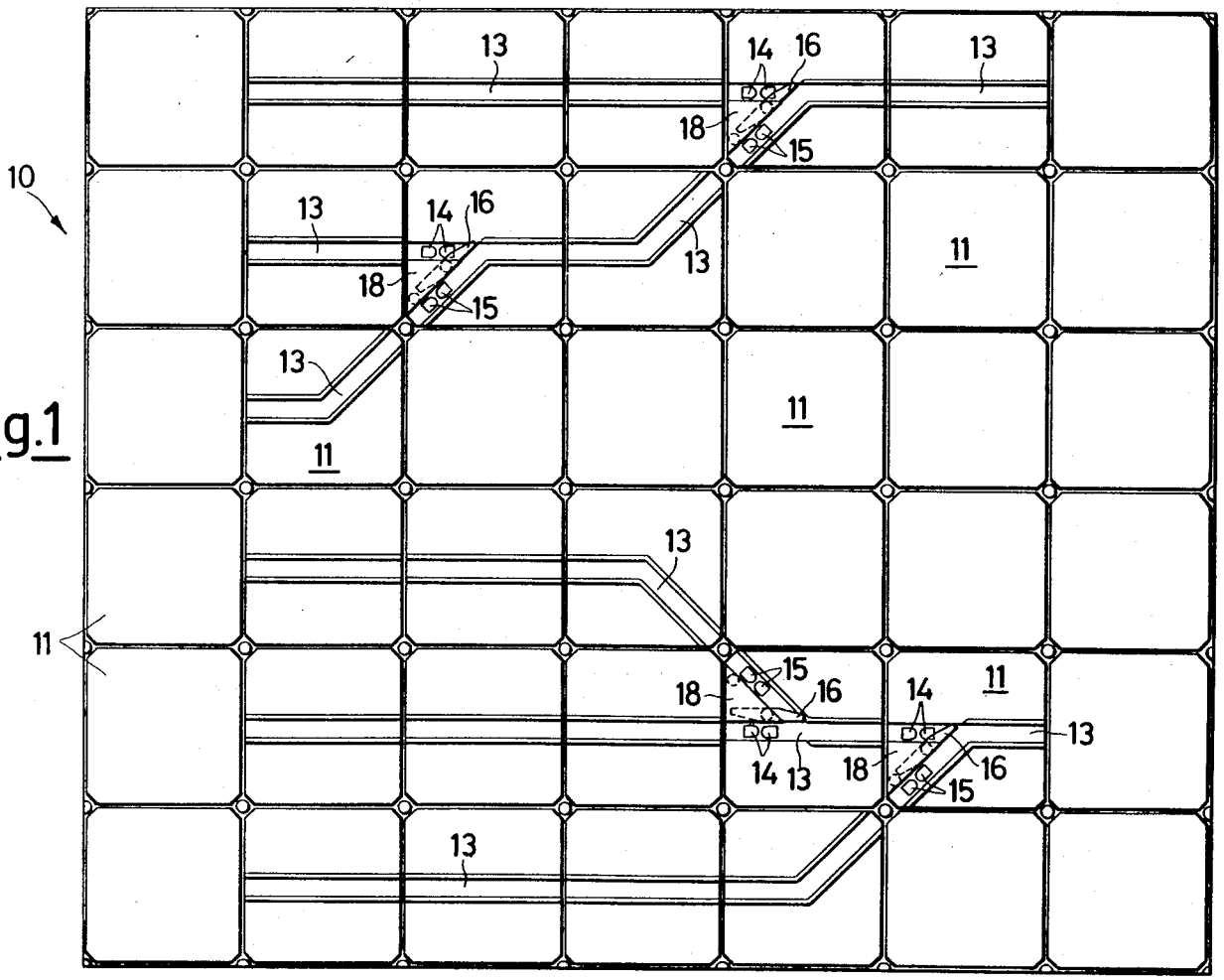
FIG. 1 is a top plan view showing a panel made according to the invention.

Having now reference to the drawings, the panel in question is generally indicated at 10 and is structurally composed of a number of square modular elements ("tiles") 11 which, by means of connecting pins 12 are removably applied to a supporting boxlike frame (not shown).

The surface of each modular element such as 11 can be either smooth, or it can have one or more grooves 13, so that it is possible to reproduce on the panel the main portions of a railway line.

In correspondence with each crossing point the grooves 13 have, on their bottoms, a couple of contacts, 14, 15, which are connected to an electric circuit 19 for controlling the switches of the railway line. Such switches are operated by closing said electric circuit by having a metallic stylus 20 sliding on the contacts, the stylus being properly electrically connected to the control circuit 19.

A control panel having the general features referred to above is quite conventional, so that no particular description thereof has been reported.

According to the present invention, in order to display the route followed by a train on the control panel, there is provided, in correspondence of each crossing of the grooves 13 (switch), a rotatable direction indicator, 16, which is capable of intersecting either groove 13 of the two which define the point of crossing and thus the switch.

In its middle point, the direction indicator 16 is pivoted to the tile 11 by means of a pivot 17, so that only one half of 16 masks either groove 13 of the two grooves which define the railway crossing, whereas the other half of 16 is masked by a fixed triangle 18.

It is thus obvious that, by running the stylus 20 through the groove 13 corresponding to the railway track on which it is desired that the train may run, the direction indicators 16 will be consequently mechanically swung by physical contact with the stylus 20 so as to display the track of interest on the control panel visually. For convenience of signalling, the direction indicators 16 and the masking triangle 18 can be made of different, optionally contrasting, colours.

Such a display device is extremely cheap because both the masking triangles and the direction indicators proper can be made of a plastics material.

I claim:

1. A panel for controlling the actuation of the switches at the crossings of a miniature railway line, said panel comprising:

(a) a support in one surface of which at least a portion of a miniature railway line is reproduced by means of grooves which correspond to a corresponding portion of the tracks of the miniature railway line, at least some of said grooves bifurcating into two downstream grooves at a plurality of control panel switching points corresponding to track switching points at which the tracks of the miniature railway line bifurcate into two downstream tracks;

(b) electrical contacts disposed in said downstream grooves adjacent to said control panel switching points, said electrical contacts being adapted to make electrical contact with a conductive stylus which can be moved through said grooves, said electrical contacts and said conductive stylus being electrically connected to an electric control circuit which actuates switches at the corresponding ones of said track switching points; and (c) a direction indicator mounted on said support adjacent to each of said control panel switching points and between the two downstream grooves emanating from each of said control panel switching points, each of said direction indicators being movable by physical contact with said conductive stylus between a first position in which it blocks a first one of the two downwstream grooves emanating from the corresponding one of said control panel switching points and unblocks the second one of the two downstream grooves emanating from the corresponding one of said control panel switching points and a second position in which it blocks the second one of the two downstream grooves emanating from the corresponding one of said control panel switching points and unblocks the first one of the two downstream grooves emanating from the corresponding one of said control panel switching points, whereby the position of said direction indicators provides a visual indication of the position of the corresponding switches in the miniature railway line.

2. A panel for controlling the actuation of the switches at the crossing of a miniature railway line as recited in claim 1 wherein said support is comprised of a plurality of modular elements which are positioned adjacent to each other when the panel is in use, said grooves extending from one to another of said plurality of modular elements.

3. A panel for controlling the actuation of the switches at the crossings of a miniature railway line as recited in claim 2 wherein said modular elements are square in plan view.

4. A panel for controlling the actuation of the switches at the crossings of a miniature railway line as recited in claim 1 wherein each of said direction indicators is rotatably mounted on said support and has two ends, one of which blocks one of the two downstream grooves emanating from the corresponding one of said control panel switching points and the other of which is disposed a small distance from said grooves when each of said direction indicators is in either its first or second positions.

5. A panel for controlling the actuation of the switches at the crossings of a miniature railway line as recited in claim 4 wherein each of said direction indicators is linear and, when said one end of each of said direction indicators blocks one of the two downstream grooves emanating from the corresponding one of said control panel switching points, said other end of each of said direction indicators is at least approximately parallel to the other of the two downstream grooves emanating from the corresponding one of said control panel switching points.

6. A panel for controlling the actuation of the switches at the crossings of a miniature railway line as recited in claim 4 and further comprising a fixed mask mounted on said support adjacent to each of said direction indicators in position to block visual observation of the one of said ends of said direction indicators which is not blocking one of said downstream grooves.

7. A panel for controlling the actuation of the switches at the crossings of a miniature railway line as recited in claim 6 wherein each of said fixed masks overlays and is shaped to correspond to the portion of the surface of said support between the two downstream grooves adjacent to the corresponding one of said control panel switching points.

8. A panel for controlling the actuation of the switches at the crossings of a miniature railway line as recited in claim 7 wherein each of said direction indicators rotates in a plane between the corresponding one of said fixed masks and the surface of said support.

9. A panel for controlling the actuation of the switches at the crossings of a miniature railway line as recited in claim 1 wherein said electrical contacts are disposed on the bottoms of said grooves.

* * * * *